United States Patent [19]

Holleck

[11] Patent Number: 4,835,062

[45] Date of Patent: May 30, 1989

[54] PROTECTIVE COATING FOR METALLIC SUBSTRATES

[75] Inventor: Helmut Holleck, Karlsruhe-Waldstadt, Fed. Rep. of Germany

[73] Assignee: Kernforschungszentrum Karlsruhe GmbH, Karlsruhe, Fed. Rep. of Germany

[21] Appl. No.: 836,628

[22] Filed: Mar. 5, 1986

[30] Foreign Application Priority Data

Apr. 11, 1985 [DE] Fed. Rep. of Germany ..... 3512986

[51] Int. Cl.[4] ..... B32B 15/04

[52] U.S. Cl. ..... 428/469; 428/472; 428/698

[58] Field of Search ..... 428/472, 213, 469, 698, 428/699

[56] References Cited

U.S. PATENT DOCUMENTS

| | | | |
|---|---|---|---|
| 3,073,717 | 1/1963 | Pyle et al. | 428/698 X |
| 3,977,061 | 8/1976 | Lindstrom et al. | 428/698 X |
| 4,060,471 | 1/1977 | Pinch et al. | 204/192 SP |
| 4,237,184 | 12/1980 | Gonseth et al. | 428/698 X |
| 4,264,682 | 4/1981 | Fuyama et al. | 428/698 X |
| 4,269,899 | 5/1981 | Fuyama et al. | 428/698 X |
| 4,403,015 | 9/1983 | Nakai et al. | 428/698 X |
| 4,554,201 | 11/1985 | Andreer et al. | 428/699 X |

FOREIGN PATENT DOCUMENTS

| | | |
|---|---|---|
| 0006534 | 4/1980 | European Pat. Off. . |
| 2917348 | 3/1980 | Fed. Rep. of Germany . |
| 3152742 | 3/1982 | Fed. Rep. of Germany . |
| 59-9169A | 6/1984 | Japan . |
| 621579 | 6/1981 | Switzerland . |
| 2045810A | 4/1980 | United Kingdom . |

OTHER PUBLICATIONS

Wilfried Schintlmeister et al., "Hartstoffbeschichtete Werkzeuge-Verschleissverhalten, Anwendung und Herstellung", Jan. 1984, Zeitschrift fër Metalldunde, vol. 75, No. 11, pp. 874–880.

Bunshah, R. F., et al., "Structure and Properties of Refractory Compounds . . . ", *Thin Solid Films,* vol. 54, No. 1, Oct. 1978, pp. 85–106.

Budhani, R. C., et al., "Microstructure and Mechanical Properties of TiC—$Al_2O_3$ Coatings", *Thin Solid Films,* vol. 118, No. 3, Aug., 1984, pp. 293–299.

*Primary Examiner*—Nancy A. B. Swisher

*Attorney, Agent, or Firm*—Spencer & Frank

[57] ABSTRACT

A protective coating for metallic substrates consists of a plurality of layers having a total thickness ranging from 0.1 to 10μ, an individual thickness for each layer ranging from 0.5 to 40 nm, and a total number of layers which does not exceed 20,000, each layer being comprised of one kind of at least two kinds of crystalline hard substances and being arranged in a sequentially alternating order with respect to the others, the crystalline hard substances having phase interfaces with respect to one another which are at least crystallographically partially coherent. In an alternate embodiment, the protective coating is a single layer which is a superfinely dispersed mixture of the crystalline hard substances. The multi-layered embodiment is provided by a method which includes positioning the metallic substrate in a physical vapor deposition apparatus; providing at least two cathodes in the apparatus, each cathode being comprised of a different kind of crystalline hard substance; continuously moving the metallic substrate sequentially past each cathode; and causing the vapor deposition of the crystalline hard substances on the metallic substrate as a protective coating having a plurality of layers. The single-layered embodiment is provided by an alternate method in which one cathode is provided and is comprised of at least two kinds of crystalline hard substances. These protective coatings have a resistance to wear which exceeds that for a coating comprised of any one of the crystalline hard substances alone.

8 Claims, 3 Drawing Sheets

PROTECTIVE COATING FOR METALLIC SUBSTRATES

BACKGROUND OF THE INVENTION

1. Field of the Invention

The present invention relates to a highly wear resistant protective coating for metallic, highly stressed surfaces or substrates, and more particularly to a protective coating which is comprised of two or more hard substances and has a total thickness ranging from 0.1 to 10 μ.

2. Discussion of the Prior Art

Hard substance protective coatings in the form of single or multiple layers on steel or hard metal substrates produced by a chemical vapor deposition process (CVD) or a physical vapor deposition (PVD) process constitute a significant advance in improved wear resistance and, thus, in service life of cutting materials or parts that are subject to wear. A hard substance coating imparts wear protection to the tough substrate by increasing the abrasion resistance of its surface, by reducing friction and thus temperature, as well as by reducing diffusion and adhesion between the material and the workpiece or chip.

Such composite materials often are characterized, however, by insufficient adhesion between the substrate material and the coating, by insufficient toughness of the coating, and by lack of resistance to alternating stresses. Multiple-layer coatings have been provided in an attempt to solve these problems. Significant improvements compared to single-layer coatings have resulted, but the aforementioned insufficient characteristics of the substrate/coating system have not yet been completely eliminated.

Multilayered coatings of hard substances on hard metal substrates are discussed, for example, in the metallurgical journal *Zeitschrift fur Metallkunde*, Volume 75, No. 11, Nov. 1984, at pages 874–880. The publication mentions, for example, a ten-layer protective coating in which a hard metal substrate is coated in turn with a titanium carbide layer (TiC), a titanium carbonitride layer (Ti(C,N)) and a layer sequence of four intermediate layers and four ceramic layers based on $Al_2O_3$. The publication also refers to a multilayered coating including layers of titanium carbide (TiC), titanium carbonitride (Ti(C,N)), and titanium nitride (TiN), and having a thickness totaling approximately 10 μ. For coating temperatures below 773° K, the physical vapor deposition (PVD) method including reactive cathode sputtering at pressures of $\leqq 10^{-2}$ bar of $N_2$ or Ar, was found to be useful. Although a significant improvement compared to single-layer coatings as noted above, the aforementioned insufficient characteristics of the substrate/coating system have not yet been completely eliminated.

SUMMARY OF THE INVENTION

It is an object of the present invention to provide wear resistant, protective coatings exhibiting improved adhesion, toughness and wear resistance, and to provide a method for producing such protective coatings. Surfaces or substrates having very different coefficients of expansion, such as, for example, molybdenum which has a very low coefficient of expansion, or a hard metal which has a medium coefficient of expansion, or a high-speed tool steel which has a high coefficient of expansion are to be coatable without significant curtailment of the desired characteristics of the substrate/protective coating system.

This is accomplished by either of two embodiments of the protective coatings according to the present invention. In a first embodiment, a protective coating for metallic substrates includes a plurality of layers having a total thickness ranging from 0.1 to 10 μ, an individual thickness for each layer ranging from 0.5 to 40 nm, and a total number of layers which does not exceed 20,000, each layer of said plurality of layers consisting essentially of one kind of at least two kinds of crystalline hard substances and alternating with a layer of another kind of said at least two kinds of crystalline hard substances, the crystalline hard substances having phase interfaces with respect to one another which are at least crystallographically partially coherent.

In a second embodiment, a protective coating for metallic substrates includes a layer comprised of at least two kinds of crystalline hard substances having phase interfaces with respect to one another which are at least crystallographically partially coherent and having particle sizes ranging from 0.5 to 40 nm, the layer being a superfinely dispersed mixture of the at least two kinds of crystalline hard substances, wherein the number of the phase interfaces does not exceed 20,000, and the layer having a total thickness ranging from 0.1 to 10 μ.

For each embodiment of the protective coating, the present invention provides a corresponding method for providing same. A first method includes positioning a metallic substrate in a physical vapor deposition apparatus; providing at least two cathodes in the apparatus, each cathode being comprised of a different kind of crystalline hard substance, the crystalline hard substances having phase interfaces with respect to one another which are at least crystallographically partially coherent; continuously moving the metallic substrate sequentially past each cathode; and causing the vapor deposition of the crystalline hard substances on the metallic substrate thereby providing the protective coating.

A second method includes positioning a metallic substrate in a physical vapor deposition apparatus; providing a cathode in the apparatus, which cathode is comprised of at least two kinds of crystalline hard substances having phase interfaces with respect to one another which are at least crystallographically partially coherent; and causing the vapor deposition of the crystalline hard substances on the metallic substrate thereby providing the protective coating.

For either version of the method according to the invention, cathodes of TiC and $TiB_2$, TiN and $TiB_2$, or Ti(C,N) and $TiB_2$ can be employed.

Additionally, cathode combinations of $TiB_2$-WC or $TiB_2$-Ti(C,N) or $TiB_2$-(Ti,V)C or $TiB_2$-(Ti,W)C or (Ti,V)$B_2$-(Ti,V)C or (Ti,Nb)$B_2$-(Ti,Nb)C or $VB_2$-TiN or $VB_2$-WC or $HfB_2$-TaC or $ZrB_2$-TaC or $ZrB_2$-NbC can be employed. That is, the at least two kinds of crystalline hard substances may include one kind from a first group and at least one kind from a second group; the first group consisting essentially of compounds of boron with one or more transition metal selected from the group consisting of Group IVB, Group VB, and both Group IVB and Group VB; and the second group consisting essentially of compounds of one of carbon and nitrogen with one or more transition metal selected from the group consisting of Group IVB, Group VB, Group VIB, and both Group IVB and one of Group VB and Group VIB.

BRIEF DESCRIPTION OF THE DRAWINGS

The invention may be better understood by referring to the detailed description of the invention when taken in conjunction with the accompanying drawing in which.

DESCRIPTION OF THE PREFERRED EMBODIMENTS

The protective coatings according to the present invention result in a significantly improved resistance to wear compared to coatings comprised of any one of the crystalline hard substances comprising same alone or compared to coatings according to the prior art. Due to the extremely high proportion of internal phase interfaces having a defined dislocation density, the successive layers or the superfinely dispersed mixture, respectively, of, for example, phases having partially coherent TiC (111)—$TiB_2$ (001) phase interfaces, are substantially free of stresses, are tougher, adhere better to the substrate and thus make the total system more wear resistant than the prior art protective coatings.

The matching of the phases forming the phase interfaces within the protective coating is of significance so that coherence relationships between net planes of the respective compounds are possible. For the combination of TiC and $TiB_2$, the most densely packed planes (111) for TiC and (001) for $TiB_2$ are the planes whose phases are matched best to establish a coherence relationship. Coherent or at least partially coherent phase interfaces are realized during the coating process. During vapor deposition by a sputtering process, for example, these phase interfaces can be obtained easily due to the favorable interface energy. Explanation for coherent and semi-coherent (partially coherent) phase interfaces:

Structures are fully coherent if they meet along a planar interface which is common to the lattices of the two structures. Rows and planes of lattice points are continuous across this interface, but change direction on passing from one crystal to the other.

The semi-coherent boundary (partially coherent) may be compared to a long-angle grain boundary. The lattices are elastically strained into coherence over local regions of the boundary, but there is an accumulating misfit which is periodically corrected by discontinuities.

Figure 1:
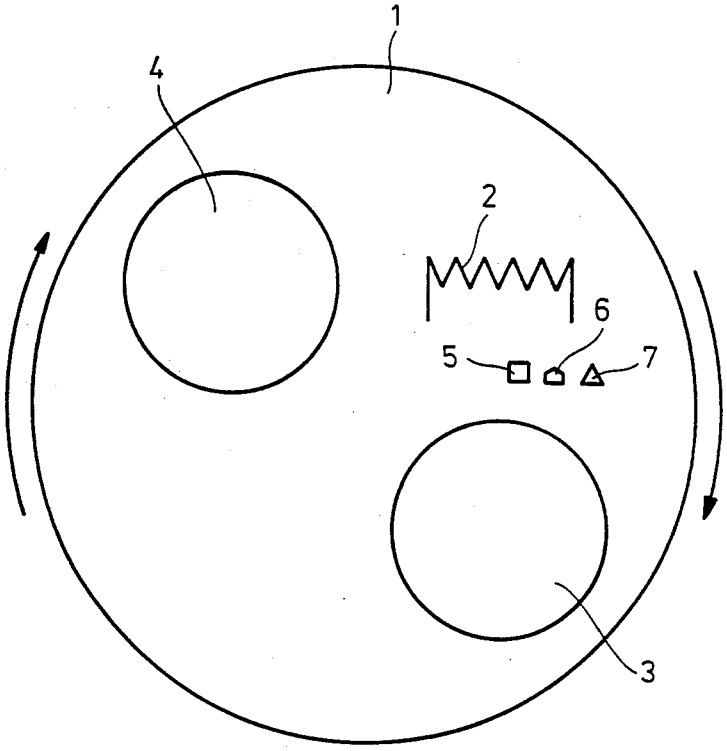
FIG. 1 is a schematic representation of a vacuum deposition apparatus useful in practicing a first embodiment of the method according to the present invention.

The method of the present invention can be better understood from FIG. 1. Substrates 5, 6, and 7 to be coated, are caused to rotate constantly during the entire vapor deposition process on a turntable 1, with or without heating, and passed beneath two cathodes 3 and 4. Cathode 3 is equipped with a quantity of, for example, TiC; the other cathode 4 equipped with a quantity of, for example, $TiB_2$. By changing the rate of rotation of the turntable and the sputter energy, the composition and microstructure of the deposited plurality of layers can be influenced directly. Preferably, conditions are selected at which the phase proportions (molar ratios) of TiC and $TiB_2$ are similar to one another and the resulting total thickness of the coating is from 3 to 5 $\mu$. Depending on the intended purpose, the calculated thickness of each individual layer lies between 0.5 and 40 nm. When the thickness of the individual layers is 0.5 nm, the number of layers preferably ranges from 100 to 20,000.

When one cathode is used, the substrates to be coated need not be rotated, but may optionally be moved past the cathode. The single cathode is equipped with quantities of at least two crystalline hard substances, for example TiC and $TiB_2$. Then, a superfinely dispersed mixture of particles is simultaneously deposited as a single layer on the substrates, the particle sizes ranging from 0.5 to 40 nm. For coatings having particle sizes which are smaller than the stated range, x-ray analysis has shown that the individual phases can no longer be separated. Rather, an amorphous, mixed coating is observed by x-ray analysis which is so stable that even the introduction of heat up to 1200° C. does not cause recrystallization.

If a micrograph is made of a break in the surface of a so-called simultaneous coating composed of, for example, $TiB_2$ and TiC, the structure of the coating is uniform and without columnar crystals or inhomogeneities. Its good adhesion can be seen from the micrograph. This good adhesion is also documented by a comparison of the results obtained with the aid of a scratch test. This relative adhesion test proves impressively the reduction of tension in the finely dispersed TiC and $TiB_2$ coating compared to single layers of TiC and $TiB_2$ taken alone. Hardness impressions in a TiC coating on the one hand and a superfinely dispersed TiC and $TiB_2$ coating on the other hand evidence the improved toughness of coatings according to the present invention. Further, due to the observable adaptability of this relatively tough coating, substances having very different coefficients of expansion can be selected as substrates.

Figure 2:
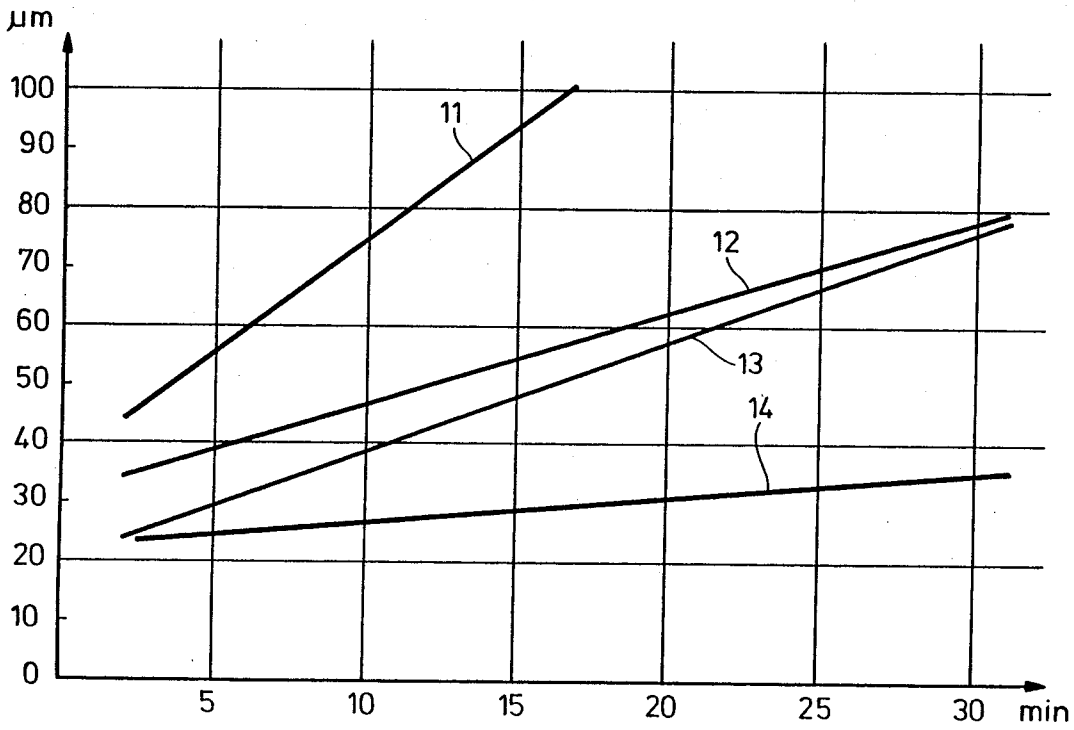
FIG. 2 is a graph presenting the results of comparative wear tests which demonstrate a two-fold increase in service life for an article protected by the coatings according to the present invention.

Wear tests were performed, as shown in FIG. 2, on cutting plates of high-speed tool steel. Shown are the results for an uncoated plate (curve 11), a plate coated with TiC (curve 12), a plate coated with $TiB_2$ (curve 13), and a plate simultaneously coated with TiC and $TiB_2$ (curve 14). In the TiC and $TiB_2$ simultaneous coating, the individual particle sizes of the TiC and $TiB_2$ particles were each calculated to be 2.5 nm. The total coating thickness was 2.9 $\mu$ and, theoretically, there were more than $10^3$ partially coherent TiC/$TiB_2$ phase interfaces in the coating perpendicular to the surface of the substrate.

Although turning conditions, the geometry of the cutting plate and the coating process were not optimized, FIG. 2 documents that service life of the cutting plate provided with a superfinely dispersed TiC and $TiB_2$ coating (curve 14) was approximately twice that of single-substance-coated cutting plates (curves 12 and 13, respectively). This is considered to be an unexpected result.

Theoretical consideration of the structure and coherence relationships of the hard substance compounds results in even better adaptation of the interfaces, for example in the production of a superfinely dispersed Ti(C,N) and $TiB_2$ coating. This is shown in FIG. 3 in which the interfaces contained in the coating are shown schematically.

As used herein, the term "Ti(C,N)" refers to mixed phases between TiC and TiN. Similarly, the terms "Ti,V)C", "(Ti,W)C", "(Ti,V)$B_2$", "(Ti,Nb)$B_2$" and (Ti,Nb)C"refer to mixed phases between binary compounds.

Figure 3:
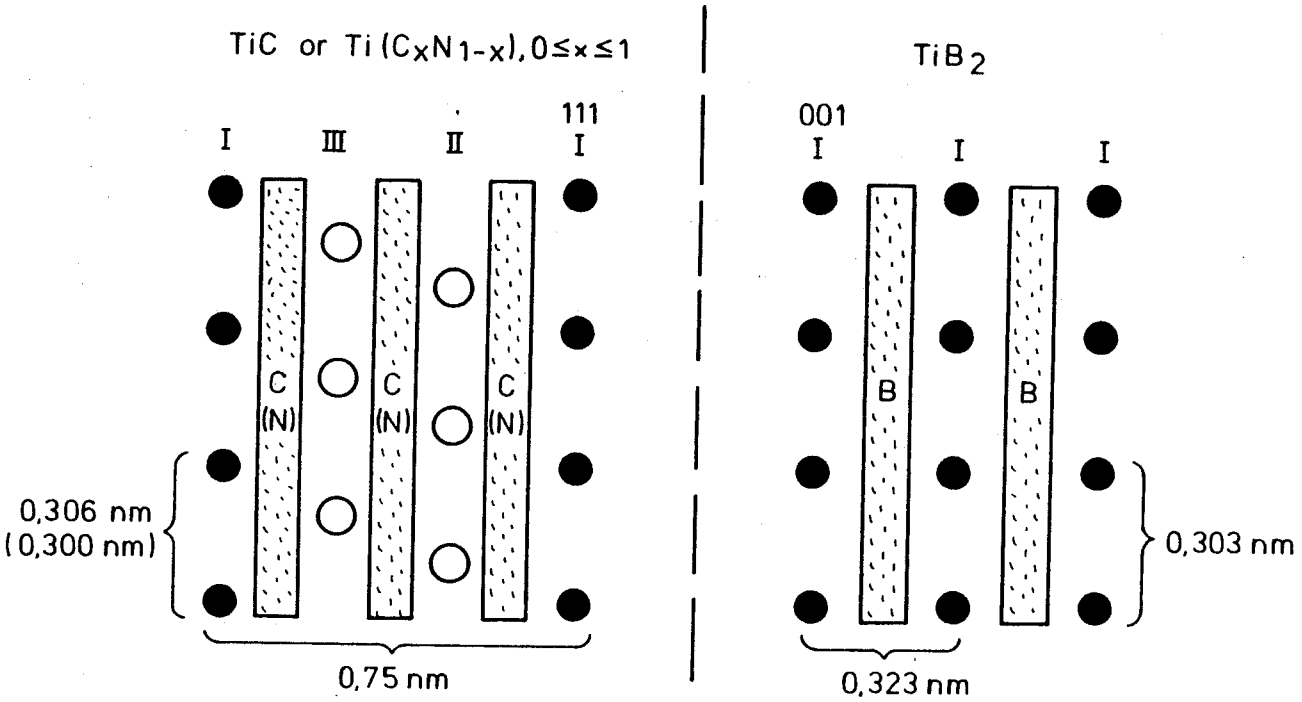
FIG. 3 is a schematic representation of one of the phase interfaces contained in a superfinely dispersed mixture of TiC or $Ti(C_xN_{1-x})$, $0 \leqq x \leqq 1$, and $TiB_2$ according to the present invention.

In FIG. 3 an example of possible coherency through the (111) planes of the cubic carbide or nitride and the (001) plane of the hexagonal boride is shown.

The planes identificated by I, II or III are closed packed metal planes. Between them carbon, nitrogen or boron planes are indicated.

(Other planes which can show semi-coherency in the TiC and $TiB_2$ structures are (110)TiC with (011)$TiB_2$, (111)TiC with (110)$TiB_2$ and (100)TiC with (100)$TiB_2$).

With reference to FIG. 3, the number "I"indicates a densely packed Ti plane. Additional Ti planes having atom centers which do not lie in the plane of the paper are indicated by the numbers "II" and "III". The letter "B" indicates boron planes for $TiB_2$, "C" the carbon planes for TiC or $Ti(C_xN_{1-x})$, $0 \leqq x \leqq 1$, and "N" the nitrogen planes for $Ti(C_xN_{1-x})$. The black and white circles both represent Ti atoms. The dashed line represents a phase interface.

Examples

1. Cutting plates of high-speed tool steel were finely polished using 3 $\mu$ diamond paste, treated for 5 minutes in an ultrasound bath and cleaned with pure alcohol. Then they were placed on the substrate plate of a sputtering system, either flat or at an angle of 45° (cutting edge upward). The vessel was evacuated to $2\times10^{-6}$ mbar and then filled with highly pure argon to a pressure of $2.0\times10^{-2}$ mbar. The samples were etched by reverse sputtering to prepare them for receiving the protective coating for 10 minutes with a power of 1000 Watts HF pro 1200 $cm^2$ (0.8 Watt/$cm^2$). Next the argon pressure was reduced to $1.3\times10^{-2}$ mbar; thereafter, the cathodes were cleaned for 1 minute at a power of 1250 and 800 Watts each pro 177 $cm^2$ cathode area, respectively, sputtering onto the aperture. The substrate plate was rotated at 1.6 rpm. Sputtering continued for five hours, with the $TiB_2$ cathode sputtering with a power of 1250 Watts, the TiC cathode with a power of 800 Watts (each pro 177 $cm^2$ cathode area). The result was a multilayered coating having a thickness of 4.1 $\mu$. For a single layer thickness of 4.4 nm, this corresponds to approximately $10^3$ TiC and $TiB_2$ interfaces.

2. The same preparations were made as for Example 1, however, etching was conducted for 10 minutes at 500 Watts pro 1200 $cm^2$ (0.4 Watt/$cm^2$), the operating pressure was $1.2\times10^{-2}$ mbar argon, the $TiB_2$ sputtering power was 650 Watts, the TiC sputtering power was 500 Watts (each pro 177 $cm^2$ cathode area), and the time 15 hours. A coating having a thickness of 7 $\mu$ was obtained. For an individual layer thickness of 2.3 nm, this corresponds to approximately $3\times10^3$ TiC and $TiB_2$ interfaces.

Example 3

A target composed of TiC and $TiB_2$ was fabricated by hot pressing at 1800° C. the powders in a 1:1 molar ratio. The target diameter was 75 mm.

The same preparations were made for the substrates as for Example 1.

Etching was conducted for 20 minutes at 1000 Watts HF (this means 0.8 Watt/$cm^2$) at a pressure of $0.3\times10^{-2}$ mbar.

The operating pressure during sputtering with 270 Watt DC (pro 43 $cm^2$) was $0.8\times10^{-2}$ mbar, sputtering time 2 hours; thickness 5 $\mu$m of a superfinely dispersed layer of TiC/$TiB_2$.

It will be understood that the above description of the present invention is susceptible to various modifications, changes, and adaptations, and the same are intended to be comprehended within the meaning and range of equivalents of the appended claims.

What is claimed is:

1. A protective coating for metallic substrates, comprising:

a plurality of layers having a total thickness ranging from 0.1 to 10 $\mu$, an individual thickness for each layer ranging from 0.5 to 40 nm, and a total number of layers which ranges from 100 to 20,000, each layer of said plurality of layers consisting essentially of one kind of at least two kinds of crystalline hard substances and alternating with a layer of another kind of said at least two kinds of crystalline hard substances, said crystalline hard substances having crystallographically phase interfaces with respect to one another which are at least partially coherent, wherein the protective coating has a resistance to wear which exceeds the resistance to wear for a coating comprised of any one of said at least two kinds of crystalline hard substances alone.

2. The protective coating according to claim 1, wherein said at least two kinds of crystalline hard substances include one kind from a first group and at least one kind from a second group, said first group consisting essentially of compounds of boron with one or more transition metal selected from the group consisting of Group IVB, Group VB, and both Group IVB and Group VB, and said second group consisting essentially of compounds of one of carbon and nitrogen with one or more transition metal selected from the group consisting of Group IVB, Group VB, Group VIB, and both Group IVB and one of Group VB and Group VIB.

3. A protective coating for metallic substrates, comprising:

a plurality of layers having a total thickness ranging from 0.1 to 10 $\mu$, an individual thickness for each layer ranging from 0.5 to 40 nm, and a total number of layers which ranges from 100 to 20,000, each layer of said plurality of layers consisting essentially of one kind of at least two kinds of crystalline hard substances and alternating with a layer of another kind of said at least two kinds of crystalline hard substances, said crystalline hard substances having crystallographic phase interfaces with respect to one another which are at least partially coherent, wherein said at least two kinds of crystalline hard substances include one kind from a first group and at least one kind from a second group, said first group consisting essentially of materials selected from the group consisting of $TiB_2$, (Ti,V)$B_2$, (Ti,Nb)$B_2$, $VB_2$, $HfB_2$ and $ZrB_2$, and said second group consisting essentially of materials selected from the group consisting of TiC, TiN, Ti(C,N), WC, (Ti,V)C, (Ti,W)C, (Ti,V)C, (Ti,Nb)C, TaC and NbC.

4. The protective coating according to claim 3, wherein said first group material is $TiB_2$ and said second group material is selected from the group consisting of TiC, TiN and Ti(C,N).

5. A protective coating for metallic substrates, comprising:

a plurality of layers having a total thickness ranging from 0.1 to 10 μ, an individual thickness for each layer ranging from 0.5 to 40 nm, and a total number of layers which ranges from 100 to 20,000, each layer of said plurality of layers consisting essentially of one kind of at least two kinds of crystalline hard substances and alternating with a layer of another kind of said at least two kinds of crystalline hard substances, said crystalline hard substances having crystallographic phase interfaces with respect to one another which are at least partially coherent, and said protective coating being prepared by a process comprising:

positioning a metallic substrate in a physical vapor deposition apparatus;

providing at least two cathodes in said apparatus, each cathode being comprised of a different kind of crystalline hard substance, wherein the at least two kinds of crystalline hard substances have crystallographic phase interfaces with respect to one another which are at least partially coherent;

continuously moving the metallic substrate sequentially past each cathode; and causing the vapor deposition of the crystalline hard substances on the metallic substrate thereby providing the protective coating.

6. The protective coating according to claim 5, wherein said at least two kinds of crystalline hard substances include one kind from a first group and at least one kind from a second group, said first group consisting essentially of compounds of boron with one or more transition metal selected from the group consisting of Group IVB, Group VB, and both Group IVB and Group VB; and said second group consisting essentially of compounds of one of carbon and nitrogen with one or more transition metal selected from the group consisting of Group IVB, Group VB, Group VIB, and both Group IVB and one of Group VB and Group VIB.

7. The protective coating according to claim 5, wherein said at least two kinds of crystalline hard substances include one kind from a first group and at least one kind from a second group, said first group consisting essentially of materials selected from the group consisting of $TiB_2$, $(Ti,V)B_2$, $(Ti,Nb)B_2$, $VB_2$, $HfB_2$ and $ZrB_2$, and said second group consisting essentially of materials selected from the group consisting of TiC, TiN, Ti(C,N), WC, (Ti,V)C, (Ti,W)C, (Ti,V)C, (Ti,Nb)C, TaC and NbC.

8. The protective coating according to claim 7, wherein said first group material is $TiB_2$ and said second group material is selected from the group consisting of TiC, TiN and Ti(C,N).

* * * * *